US007497195B2

(12) United States Patent
Umezu et al.

(10) Patent No.: US 7,497,195 B2
(45) Date of Patent: Mar. 3, 2009

(54) ENGINE CONTROL DEVICE OF CONSTRUCTION MACHINERY

(75) Inventors: Yoshiyasu Umezu, Hiroshima (JP); Yoshiki Kamon, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 566 days.

(21) Appl. No.: 10/542,656

(22) PCT Filed: Dec. 26, 2003

(86) PCT No.: PCT/JP03/16914

§ 371 (c)(1),
(2), (4) Date: Jul. 19, 2005

(87) PCT Pub. No.: WO2004/070180

PCT Pub. Date: Aug. 19, 2004

(65) Prior Publication Data

US 2006/0048735 A1 Mar. 9, 2006

(30) Foreign Application Priority Data

Feb. 3, 2003 (JP) ..... 2003-026172

(51) Int. Cl.
*F02N 17/00* (2006.01)

(52) U.S. Cl. ..... 123/179.4; 123/179.2; 701/113

(58) Field of Classification Search ..... 123/179.3, 123/179.4; 701/113
See application file for complete search history.

(56) References Cited

U.S. PATENT DOCUMENTS 1,269,637 A * 6/1918 Olmsted ..... 290/37 R
4,421,075 A * 12/1983 Mandel ..... 123/142.5 R
4,648,364 A * 3/1987 Wills ..... 123/198 D
4,930,466 A * 6/1990 Osborne, Jr. ..... 123/179.5
5,072,701 A * 12/1991 Khan et al. ..... 123/142.5 E
6,363,906 B1 * 4/2002 Thompson et al. .... 123/198 DB
6,532,926 B1 * 3/2003 Kuroda et al. ..... 123/179.4
6,595,180 B2 * 7/2003 Thompson et al. .... 123/198 DB
6,629,515 B1 10/2003 Yamamoto et al.
2001/0025220 A1 * 9/2001 Kaneko et al. ..... 701/112

(Continued)

FOREIGN PATENT DOCUMENTS

EP 1 223 323 A2 7/2002

(Continued)

*Primary Examiner*—Stephen K Cronin
*Assistant Examiner*—Arnold Castro
(74) *Attorney, Agent, or Firm*—Oblon, Spivak, McClelland, Maier & Neustadt, P.C.

(57) ABSTRACT

An engine control device for a construction machine of the present invention is configured so that the engine control device comprises an engine as a power source, a controller for performing an automatic stop control to automatically stop the engine when a predetermined automatic stop condition is met, a water temperature sensor for detecting a cooling water temperature of the engine, and that after start-up of the engine, even if the automatic stop condition is met, the engine is not automatically stopped until the detected water temperature reaches a predetermined value or more to complete a warm-up operation. The engine control device is also configured so that before the engine is automatically stopped, a cool-down operation of the engine is performed as required and after the engine is stopped, the engine is restarted as required and the warm-up operation is performed.

19 Claims, 7 Drawing Sheets

U.S. PATENT DOCUMENTS

| | | | | |
|---|---|---|---|---|
| 2002/0033157 | A1 * | 3/2002 | Thompson et al. | 123/179.4 |
| 2002/0092295 | A1 | 7/2002 | Suzuki et al. | |
| 2003/0014178 | A1 | 1/2003 | Miki | |

FOREIGN PATENT DOCUMENTS

| | | |
|---|---|---|
| JP | 48-37818 | 6/1973 |
| JP | 58-98443 | 7/1983 |
| JP | 1-155037 | 6/1989 |
| JP | 6-167243 | 6/1994 |
| JP | 9-49446 | 2/1997 |
| JP | 2000-096627 | 4/2000 |
| JP | 2001-041069 | 2/2001 |
| WO | WO 01/66922 A1 | 9/2001 |

* cited by examiner

ENGINE CONTROL DEVICE OF CONSTRUCTION MACHINERY

TECHNICAL FIELD

The present invention relates to an engine control device for a construction machine in which an engine is automatically stopped (auto stop) in non-operation time.

BACKGROUND ART

A construction machine including an automatic stop function for automatically stopping an engine when predetermined automatic stop conditions (for example, a gate lever for opening and closing a gateway to a cabin is opened and a lever for operating a work actuator is in non-operation) is met has been disclosed in Japanese Patent Laid-Open Nos. 2000-96627 and 2001-41069.

However, when the automatic stop conditions are met, an engine is automatically stopped only by the condition. Thus, when for example an operator leaves a machine for inspections or the like during a warm-up operation after start-up of the engine particularly in the cold time, the engine is automatically stopped in the middle of the warm-up operation.

As a result, the engine is automatically stopped while keeping a low-temperature state in a non warm-up machine, and after that, a restarting operation of the engine puts a heavy load on the engine and peripheral devices such as a water pump and a cell motor (hereinafter referred to as engine and the like), which is likely to cause a failure.

Further, since the restarting operation of the engine must be performed, a heavy load is put on an operator's operation.

It is noted that although only canceling an automatic stop control before warming up the machine is enough to avoid this situation, the operation is troublesome or can be forgotten.

Further, other problems are as follows:

1) since the engine can be suddenly stopped while being in a high temperature state, a heavy load is put on the engine and the like from this point of view;
2) when a period after the engine is stopped by the automatic stop control until restarting the engine is long particularly in the cold time, the engine is cooled down and the restart becomes troublesome. Thus a heavy load is put on the engine and the like even in this case.

It is an object of the present invention to provide an engine control device for a construction machine provided with an automatic stop function, which can protect an engine and the like.

DISCLOSURE OF THE INVENTION

To solve the above-mentioned problems the present invention adopted the following configurations.

The present invention is configured so that an engine control device for a construction machine comprises an engine as a power source, control means for performing an automatic stop control to automatically stop the engine when a predetermined automatic stop condition is met, and warm-up state detecting means for detecting a warm-up state of the engine and that the control means is adapted to perform the automatic stop control in a condition that completion of a warm-up operation for the engine is detected by the warm-up state detecting means.

According to the configuration of the present invention, since the automatic stop control always serves after the warm-up operation of the engine is completed, there is no fear that the engine is automatically stopped keeping a low temperature state before warming up. As a matter of course, the engine is not restarted under a non warm-up state. Therefore, a load on the engine and the peripheral devices can be reduced.

Further, there are no troubles of canceling the automatic stop control before warming up and of restarting the engine for warming up.

Further, the present invention is configured so that an engine control device for a construction machine comprises an engine as a power source, control means for performing an automatic stop control to automatically stop the engine when a predetermined automatic stop condition is met, and cool-down necessity detecting means for detecting whether or not the engine is in a state where a cool-down operation is required and that the control means performs the automatic stop control in a condition that a cool-down period is kept before the engine is automatically stopped when the cool-down necessity detecting means detects that the engine is in an operation state where it requires the cool-down operation.

According to the configuration of the present invention, since the cool-down operation of the engine is performed as required before the engine is automatically stopped, there is no fear that the engine is stopped keeping a high temperature state. Accordingly, generation of troubles such as seizing of a turbine shaft is prevented so that the engine and the like can be protected.

Further, the present invention is configured so that an engine control device for a construction machine comprises an engine as a power source, control means for performing an automatic stop control to automatically stop the engine when a predetermined automatic stop condition is met, and warm-up necessity detecting means for detecting whether or not the engine is in a state where it requires a warm-up operation of the engine, and that the control means is adapted to automatically restart the engine when the warm-up necessity determining means detects that the engine is in a state where the warm-up operation is required after the engine is automatically stopped by the automatic stop control.

According to the configuration of the present invention, since after the engine is stopped by the automatic stop control in the cold time the engine is automatically restarted as required and the warm-up operation is performed, the engine can be maintained at a temperature state suitable for the next start.

Thus, a load on the engine and the like due to the restart of the engine at a low temperature can be eliminated and the restart of the engine becomes easy.

Furthermore, since the automatic stop control is utilized, an essential object of the control of fuel saving and the like can also be attained.

BEST MODE FOR CARRYING OUT THE INVENTION

Figure 1:
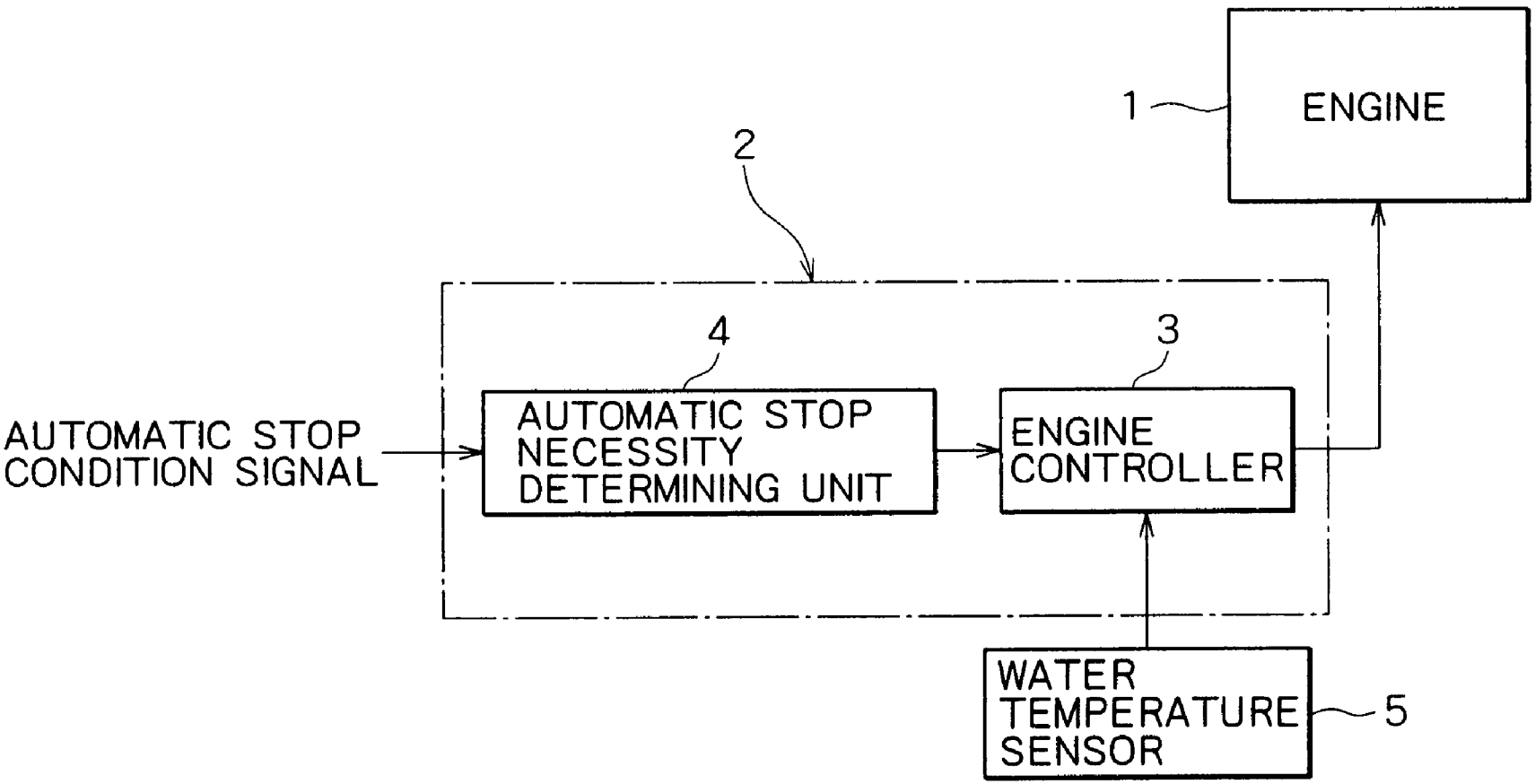
FIG. 1 is a block diagram showing a first embodiment of the present invention.
Figure 2:
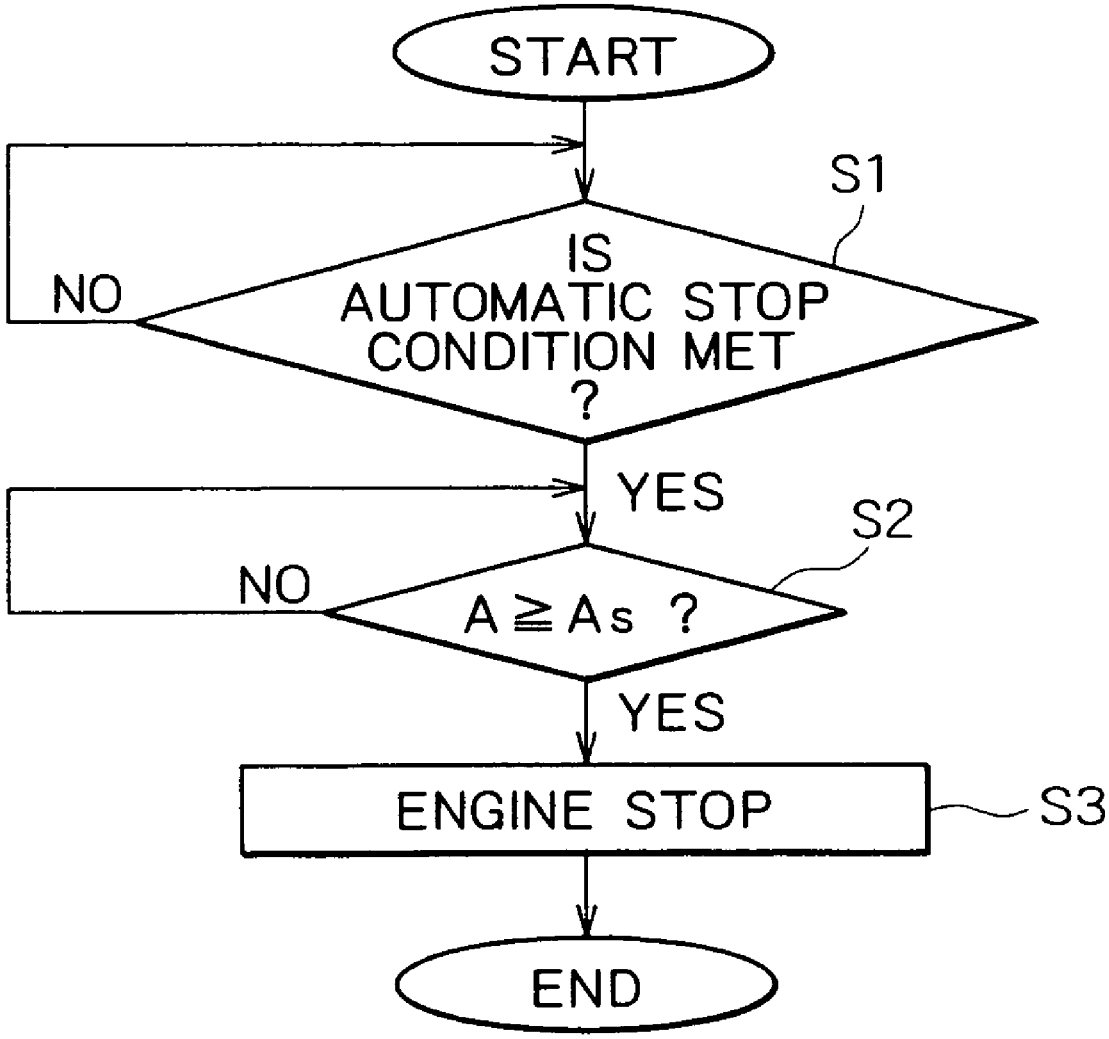
FIG. 2 is a flow chart for explaining an action of the first embodiment.

First Embodiment (see FIGS. 1 and 2)

An engine 1 as a power source is controlled by a controller 2 as control means.

The controller 2 includes an engine controller 3 for sending a signal of a stop command to the engine 1 (particularly engine governor controller) and an automatic stop necessity determining unit 4 for determining whether or not it is necessary to perform an automatic stop control as a previous stage.

To this automatic stop necessity determining unit 4 is input a signal relating to a predetermined automatic stop condition. Necessity of the automatic stop control is determined based on this automatic stop condition signal.

It is noted that the automatic stop condition is, for example, any one or both of the following conditions:

1) a gate lever for opening and closing a gateway of a cabin is opened;
2) an operating lever as operation means for operating a work actuator is in non-operation.

The automatic stop condition is detected by a switch for turning ON/OFF in synchronization with movements of the respective levers and sent to the automatic stop necessity determining unit 4.

In a case where a machine of a canopy structure having no cabin has alternative means for the gate lever with regard to the above 1), the fact that this alternative means is operated becomes a condition of 1). For example, when an operating lever box provided with an operating lever is liftable and lowerable and is lowered at the seating of an operator, a condition of 1) is that the operating lever box is lifted (opened).

Further, a water temperature sensor 5 as a temperature detector for detecting a cooling water temperature of the engine, as an engine coolant is provided. In a condition that a water temperature A detected by the water temperature sensor 5 is a predetermined temperature (hereinafter referred to as warm-up completion temperature) As or more, the automatic stop control becomes possible. In other words, even though the automatic stop conditions are met, if a requirement of $A \geqq As$ is not satisfied, the automatic stop control is not started.

Actions of these points will be explained by way of a flow chart of FIG. 2.

As soon as the automatic stop control is started, it is determined whether or not the automatic stop conditions are met (Step S1). In a case of NO, the processing flow does not advance to the next step. In a case of YES, it is determined whether or not the requirement of $A \geqq As$ is satisfied in Step S2.

Here in only a case of YES (in a case where the detected water temperature A is the warm-up completion temperature As or more), the engine 1 is automatically stopped in Step S3.

As described above, after the warm-up operation of the engine the automatic stop control always serves. Thus, even if the operator leaves a machine for inspections or the like after starting the engine and the automatic stop conditions 1) and 2) are met, the engine 1 is not stopped if it is prior to warming up (in a case of $A<As$).

Accordingly, there is no fear that the engine 1 is stopped while keeping a low temperature state in a non warm-up machine and a restarting operation puts a load on the engine and the peripheral devices.

Further, in a machine having a function of canceling the automatic stop control, there are no troubles of previously canceling the automatic stop control before warming up as well as restarting the engine for warming up.

Figure 3:
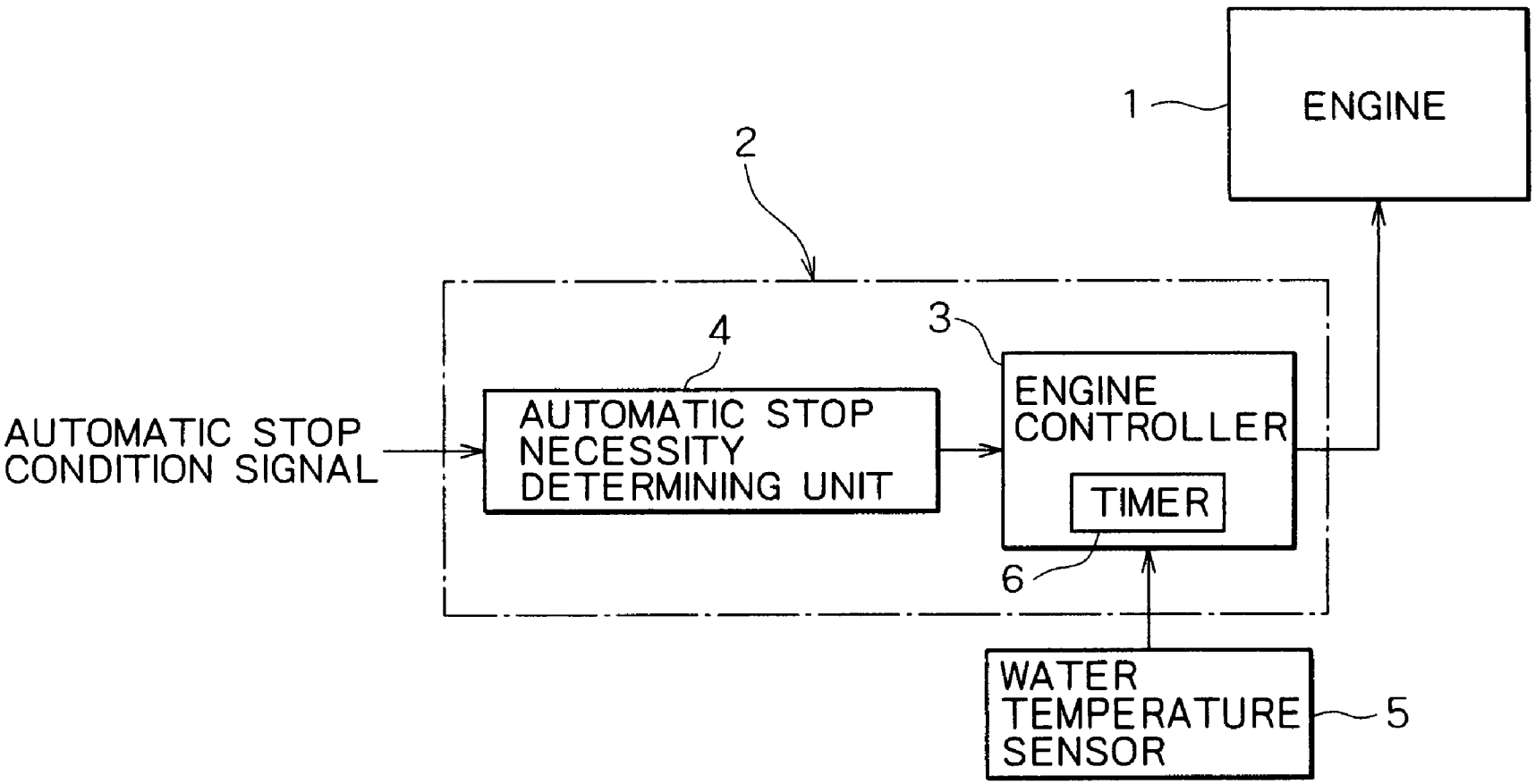
FIG. 3 is a block diagram showing a second embodiment of the present invention.
Figure 4:
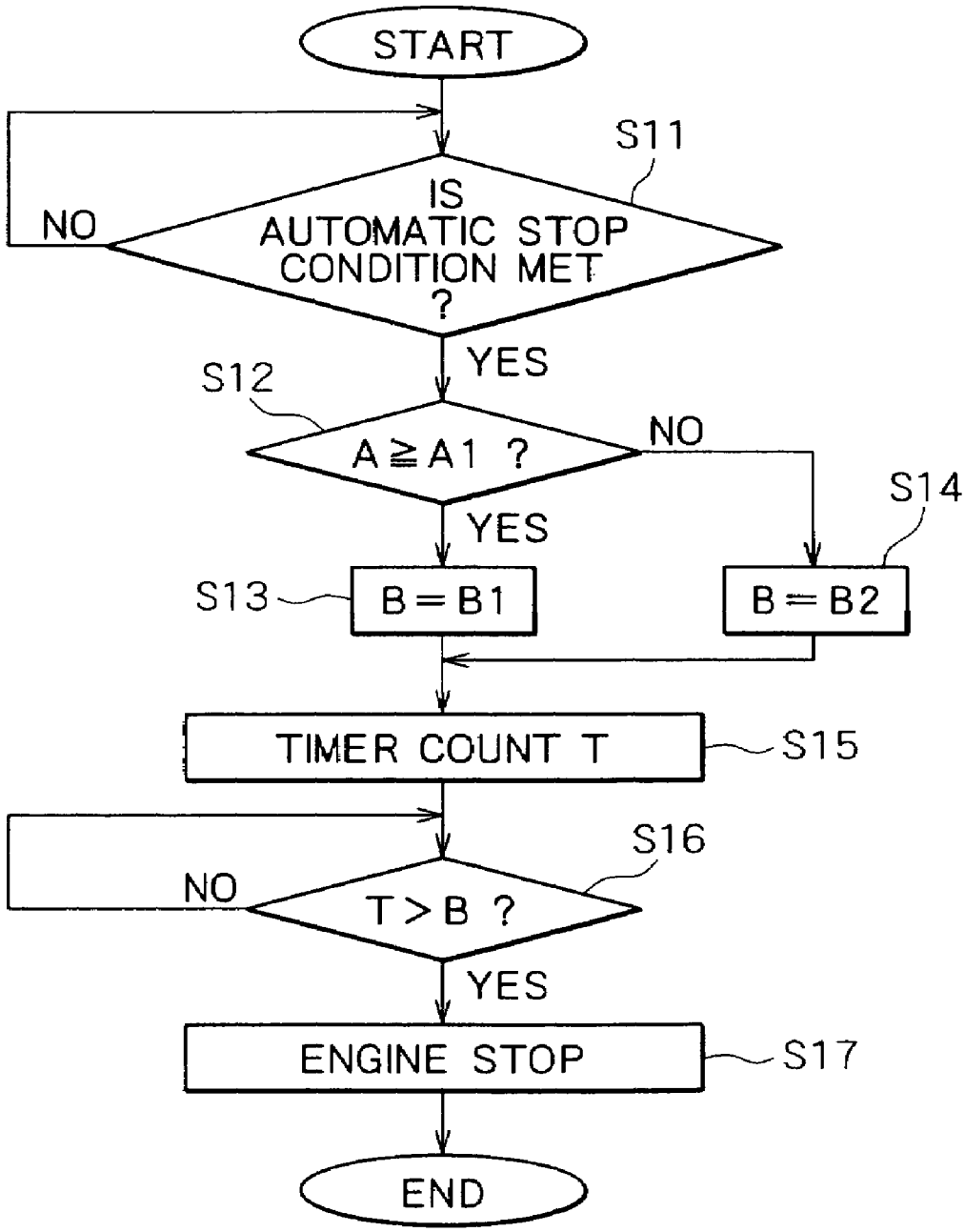
FIG. 4 is a flow chart for explaining an action of the second embodiment.

Second Embodiment (see FIGS. 3 and 4)

Only different points from the first embodiment will be described in the following embodiments.

When the engine 1 is stopped while keeping a high temperature state, troubles such as seizing of a turbine shaft can be generated.

Thus, in the second embodiment, a cool-down operation of reducing (cooling) a temperature of the engine 1 is automatically performed as required before the automatic stop control is started. In this case, a period of the cool-down operation is automatically selected among two types in accordance with a detected temperature and is counted by a timer 6 provided in the engine controller 3.

Namely, in a flow chart of FIG. 4, when the automatic stop conditions are met (in a case of YES in Step S11), the detected water temperature A is compared with a predetermined reference temperature A1 in Step S12. If a requirement of $A \geqq A1$ is satisfied in Step S12, a set value B1 as a cool-down time B is selected in Step S13. If a requirement of $A<A1$ is satisfied, a set value B2 as a cool-down period B is selected in Step S14. Here $B1>B2$ is satisfied.

In the subsequent Step S15, a timer count is performed at the set value B1 or B2, and after a count up (in a case where the number of counts $T>B$ is satisfied so as to exceed the set value; in a case of YES in Step S16) the engine 1 is automatically stopped in Step S17.

It is noted that a fixed cool-down period can be appropriately determined with regard to the set values B1, B2 of cool-down periods in accordance with a cool-down performance, a use environment or the like. In this case, if the reference temperature A1 is set to a minimum value of a temperature at which a cool-down is required, since the cool-down operation is not required at $A<A1$, the set value B2 on the short time side is 0 (no cool-down operation).

Further, three or more set values of the cool-down periods may be automatically selected.

Thus, since the cool-down operation of the engine 1 is performed as required before the engine is automatically stopped, there is no fear that the engine 1 is stopped keeping a high temperature state. Accordingly, generation of troubles such as seizing of a turbine shaft is prevented so that the engine and the like can be protected.

Further, in the second embodiment, since the cool-down period B is automatically selected from two periods B 1 and B2 in accordance with a level of the detected water temperature A, a right appropriate cool-down operation can be performed.

Figure 5:
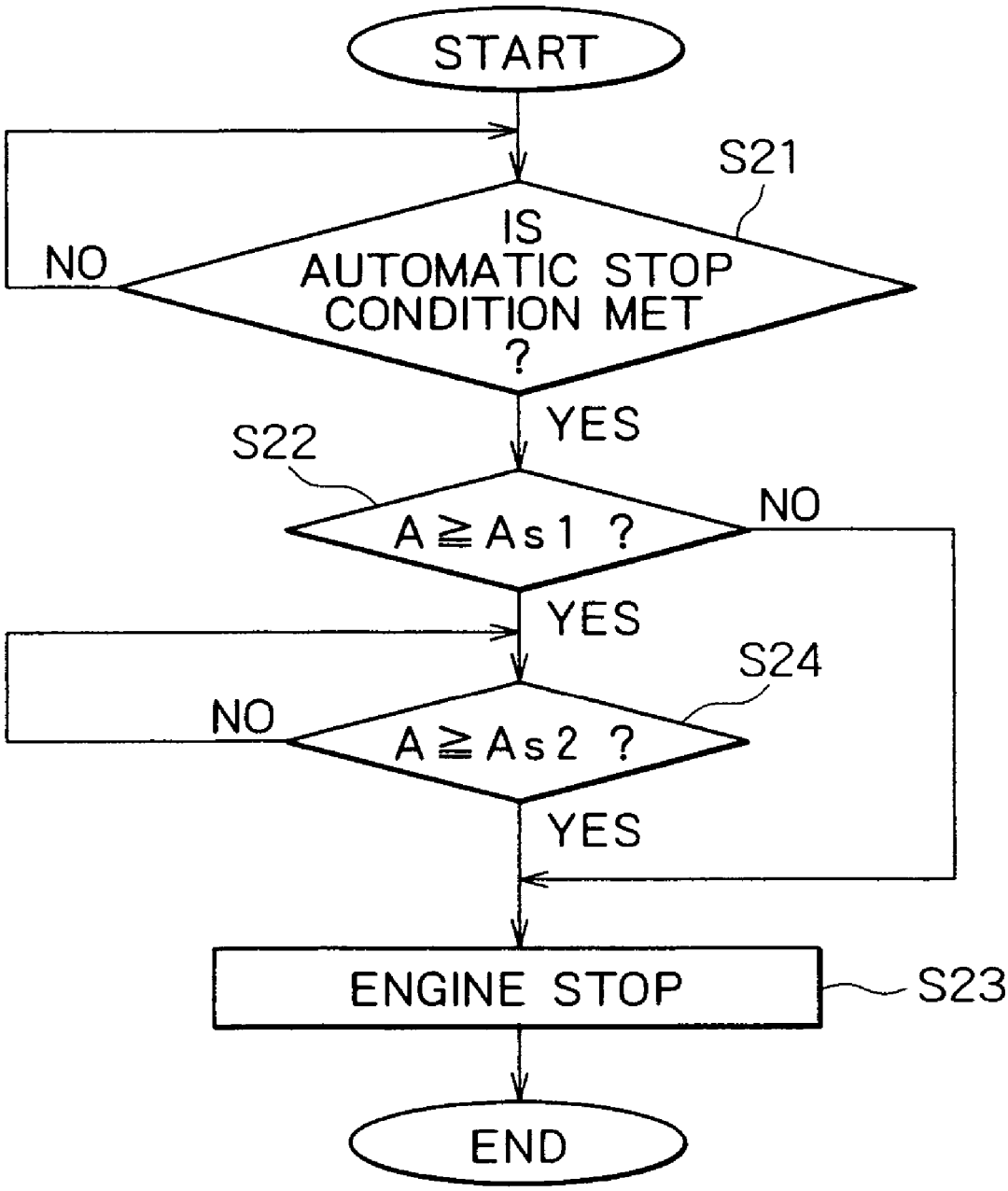
FIG. 5 is a flow chart for explaining an action of a third embodiment of the present invention.

Third Embodiment (see FIG. 5)

The third embodiment is configured as a modified embodiment from the second embodiment so that an engine is stopped after it is determined whether a cool-down operation is required or not and completion of the cool-down is detected.

Since the block configuration of the third embodiment is apparently the same as FIG. 1, a drawing is omitted while using FIG. 1.

Actions of the third embodiment will be described with reference to FIG. 5. After it is determined that the automatic stop conditions are met in Step S21, the detected water temperature A is compared with a cool-down starting temperature As1 predetermined as a temperature at which the cool-down operation should be started (Step S22).

In a case of NO, that is in a case of A<As1, since the cool-down operation is not required, an engine stop action is immediately performed in Step S23.

On the other hand, in a case where it is determined to be A≧As1 in Step S22 (in a case of YES in Step S22), after the cool-down operation is performed until the detected water temperature A is reduced to a cool-down completion temperature As2 or less predetermined as a temperature at which the cool-down may be completed (in a case of YES in Step S24), the engine is stopped in Step S23.

As described above, since the cool-down is performed only as required and the automatic stop control serves to stop the engine 1 when the cool-down is completed, losses of period and energy can be eliminated.

Figure 6:
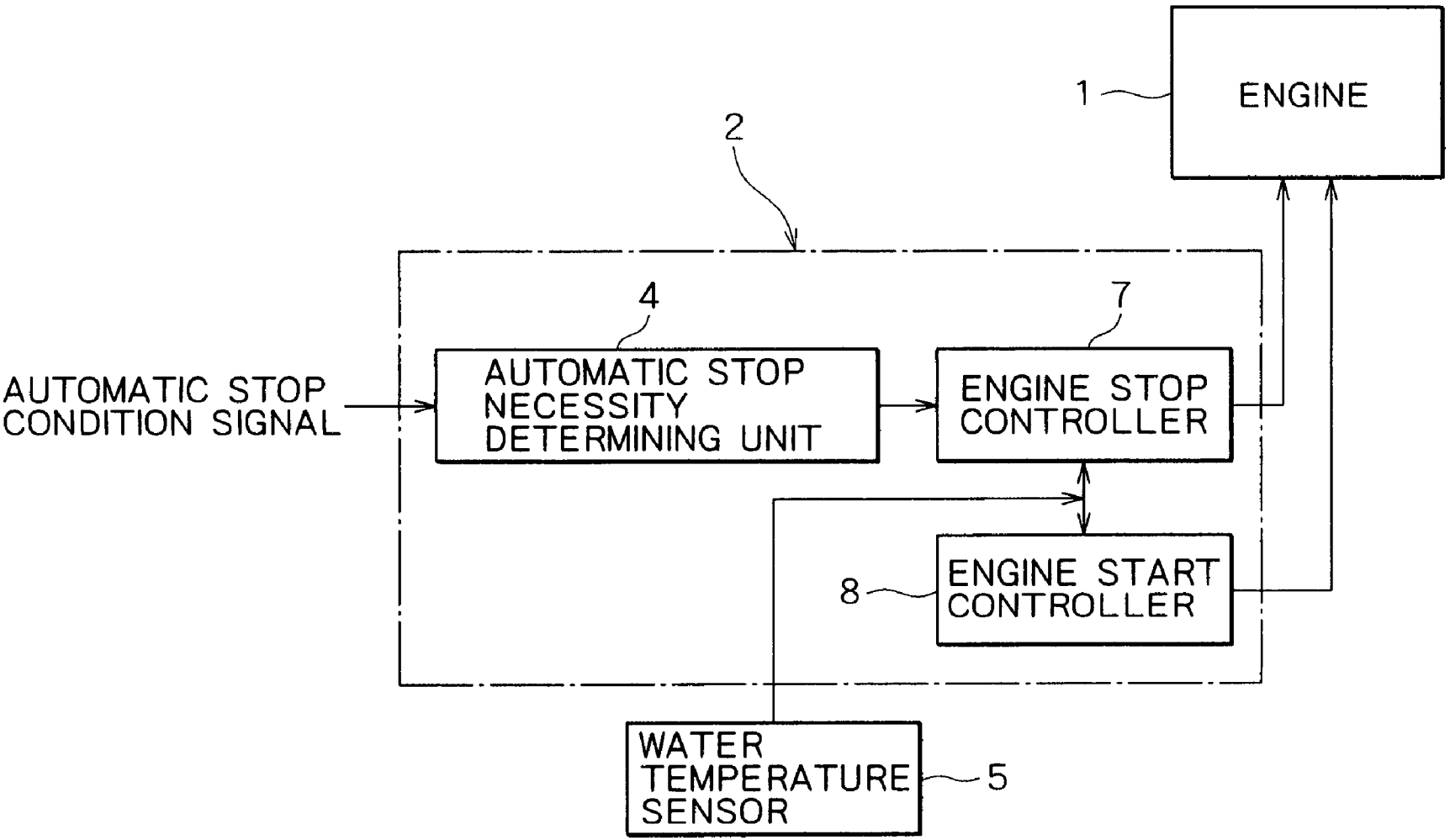
FIG. 6 is a block diagram showing a fourth embodiment of the present invention.
Figure 7:
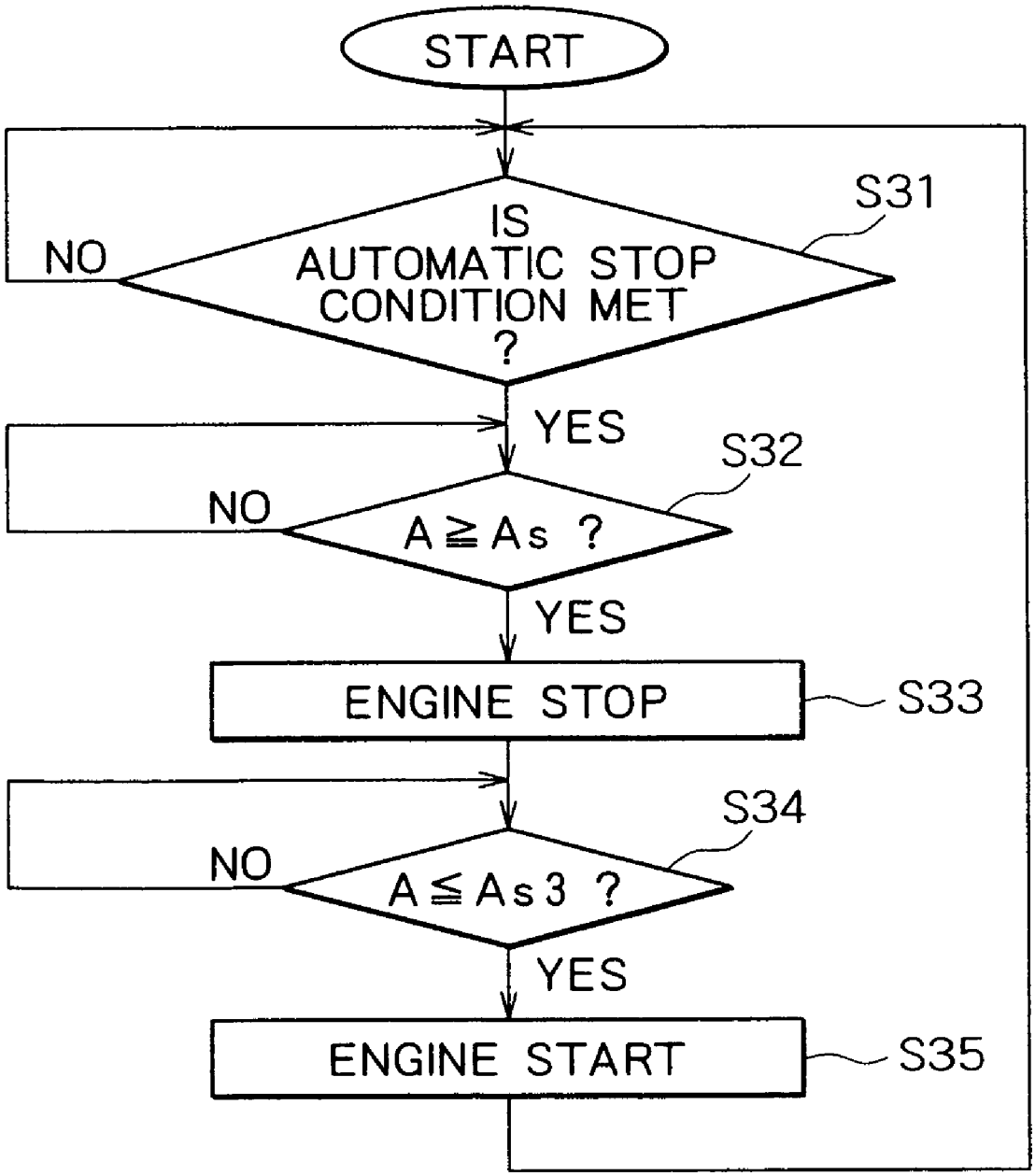
FIG. 7 is a flow chart for explaining an action of the fourth embodiment.

Fourth Embodiment (see FIGS. 6 and 7)

When a period after an engine is stopped by an automatic stop control until restarting the engine is increased particularly in the cold time, the engine 1 is cooled down and its restart becomes troublesome and at the same time a load on the engine or the like is increased.

Thus, in the fourth embodiment, the controller 2 is provided with an engine stop controller (corresponding to the engine controller 3 in FIG. 1) 7 for automatically stopping the engine 1 and an engine start controller 8 for automatically warming up the engine after the engine is automatically stopped. In addition to a warm-up ensuring action before the engine is automatically stopped in the first embodiment, the warm-up operation of the engine is automatically performed as required after the engine is automatically stopped.

An action of the fourth embodiment will be described with reference to FIG. 7. When the detected water temperature A reaches the warm-up completion temperature As or more after it is determined that the automatic stop conditions are met in Step S31, the engine 1 is automatically stopped (Steps S32 and S33).

When the detected water temperature A reaches a warm-up start temperature As3 or less predetermined as a temperature at which the warm-up operation should be started after the engine is automatically stopped (YES in Step S34), the engine 1 is automatically started by a command signal from the engine start controller 8 so that the warm-up operation is started (Step S35).

After that the processing flow returns back to Step S31 and the warm-up operation is performed in Step S33 through Step S32 until the engine 1 is automatically stopped.

Other Embodiments (1) A temperature of cooling water is detected as a temperature of a portion where a temperature is increased in accordance with the operation of the engine in the above-mentioned respective embodiments. Alternatively, a working oil temperature or an exhaust temperature may be detected.

(2) The fourth embodiment adopted a configuration in which the warm-up ensuring action and the automatic warm-up action are combined with each other. However, to enhance protection effects of the engine and the like, the following combinations may be used:

(i) the cool-down action of the second or third embodiment and the automatic warm-up action of the fourth embodiment;

(ii) the warm-up ensuring action and the cool-down action;

(iii) the warm-up ensuring action, the cool-down action and the automatic warm-up action.

In this case, any two or all of the warm-up ensuring action for not automatically stopping the engine before the completion of the warm-up operation, the automatic cool-down action for performing the cool-down operation as required before the engine is automatically stopped and the automatic warm-up action for automatically maintaining a warm-up state of the engine can be obtained as the combination.

That is the warm-up ensuring action and the cool-down action, the cool-down action and the automatic warm-up action, the warm-up ensuring action and the automatic warm-up action, or all of the three actions can be obtained.

Accordingly, the protection effects of the engine and the like are very high.

INDUSTRIAL APPLICABILITY

As described above, according to the present invention, since an automatic stop control always serves after a warm-up operation of an engine is completed, there is no fear that the engine is automatically stopped keeping a low temperature state before warming up. As a matter of course, the engine is not restarted under a non warm-up state. Therefore, a load on the engine and peripheral devices can be reduced.

Further, there are no troubles of canceling the automatic stop control before warming up and of restarting the engine for warming up.

What is claimed is:

1. An engine control device for a construction machine, comprising:

an engine as a power source, control means for performing an automatic stop control to automatically stop said engine when a predetermined automatic stop condition is met, wherein said automatic stop condition comprises a condition other than a completion of a warm-up operation for said engine, and warm-up state detecting means for detecting a warm-up state of said engine, wherein said control means performs said automatic stop control only after completion of the warm-up operation for said engine is detected by said warm-up state detecting means.

2. An engine control device for a construction machine, comprising:

an engine as a power source, control means for performing an automatic stop control to automatically stop said engine when a predetermined automatic stop condition is met, wherein said automatic stop condition comprises a condition other than a completion of a cool down operation for said engine, and cool-down necessity detecting means for detecting whether or not said engine is in a state where a cool-down operation is required and wherein said control means performs said automatic stop control only after completion of a cool-down period when said cool-down necessity detecting means detects that said engine is in an operation state where said engine requires the cool-down operation.

3. The engine control device for the construction machine according to claim 2, wherein, as said cool-down necessity detecting means, a temperature detector for detecting a temperature of a portion whose temperature increases in accordance with an operation of said engine, and said control means is adapted to select a required cool-down period in accordance with the detected temperature by said temperature detector.

4. The engine control device for the construction machine according to claim 3, wherein said control means automatically selects one of a plurality of cool-down period patterns in accordance with the detected temperature by said temperature detector.

5. The engine control device for the construction machine according to claim 2, wherein said control means stops said engine when completion of the cool-down operation of said engine is detected by said cool-down necessity detecting means.

6. An engine control device for a construction machine, comprising:

an engine as a power source, control means for performing an automatic stop control to automatically stop said engine when a predetermined automatic stop condition is met, wherein said automatic stop condition comprises a condition other than a completion of a warm-up operation for said engine, and warm-up necessity detecting means for detecting whether or not said engine is in a state where a warm-up operation of said engine is required, and wherein said control means automatically restarts said engine when said warm-up necessity detecting means detects that said engine is in the state where the warm-up operation is required after said engine is automatically stopped by said automatic stop control.

7. The engine control device for the construction machine according to claim 6, wherein said engine control device further comprises warm-up state detecting means for detecting a warm-up state of said engine and said control means performs said automatic stop control in a condition that completion of the warm-up operation is detected by said warm-up state detecting means.

8. The engine control device for the construction machine according to claim 2, wherein said engine control device further comprises warm-up state detecting means for detecting a warm-up state of said engine, and said control means is adapted to perform said automatic stop control in a condition that completion of a warm-up operation is detected by said warm-up state detecting means.

9. The engine control device for the construction machine according to claim 2, wherein said engine control device further comprises warm-up necessity detecting means for detecting whether or not said engine is in a state where a warm-up operation is required, and said control means is adapted to automatically restart said engine when said warm-up necessity detecting means detects that said engine is in the state where the warm-up operation is required after said engine is automatically stopped by said automatic stop control.

10. The engine control device for the construction machine according to claim 2, wherein said engine control device further comprises warm-up state detecting means for detecting a warm-up state of said engine and warm-up necessity detecting means for detecting whether or not said engine is in a state where a warm-up operation is required, and that said control means comprising:

A) performing an automatic stop control in the condition that completion of the warm-up operation is detected by said warm-up state detecting means; and B) restarting said engine when said warm-up necessity detecting means detects that said engine is in the state where the warm-up operation is required after said engine is automatically stopped by said automatic stop control.

11. The engine control device for the construction machine according to claim 3, wherein said engine control device further comprises warm-up state detecting means for detecting a warm-up state of said engine, and said control means is adapted to perform said automatic stop control in a condition that completion of a warm-up operation is detected by said warm-up state detecting means.

12. The engine control device for the construction machine according to claim 4, wherein said engine control device further comprises warm-up state detecting means for detecting a warm-up state of said engine, and said control means is adapted to perform said automatic stop control in a condition that completion of a warm-up operation is detected by said warm-up state detecting means.

13. The engine control device for the construction machine according to claim 5, wherein said engine control device further comprises warm-up state detecting means for detecting a warm-up state of said engine, and said control means is adapted to perform said automatic stop control in a condition that completion of a warm-up operation is detected by said warm-up state detecting means.

14. The engine control device for the construction machine according to claim 3, wherein said engine control device further comprises warm-up necessity detecting means for detecting whether or not said engine is in a state where a warm-up operation is required, and said control means is adapted to automatically restart said engine when said warm-up necessity detecting means detects that said engine is in the state where the warm-up operation is required after said engine is automatically stopped by said automatic stop control.

15. The engine control device for the construction machine according to claim 4, wherein said engine control device further comprises warm-up necessity detecting means for detecting whether or not said engine is in a state where a warm-up operation is required, and said control means is adapted to automatically restart said engine when said warm-up necessity detecting means detects that said engine is in the state where the warm-up operation is required after said engine is automatically stopped by said automatic stop control.

16. The engine control device for the construction machine according to claim 5, wherein said engine control device further comprises warm-up necessity detecting means for detecting whether or not said engine is in a state where a warm-up operation is required, and said control means is adapted to automatically restart said engine when said warm-up necessity detecting means detects that said engine is in the state where the warm-up operation is required after said engine is automatically stopped by said automatic stop control.

17. The engine control device for the construction machine according to claim 3, wherein said engine control device further comprises warm-up state detecting means for detecting a warm-up state of said engine and warm-up necessity detecting means for detecting whether or not said engine is in a state where a warm-up operation is required, and that said control means comprising:

A) performing an automatic stop control in the condition that completion of the warm-up operation is detected by said warm-up state detecting means; and B) restarting said engine when said warm-up necessity detecting means detects that said engine is in the state where the warm-up operation is required after said engine is automatically stopped by said automatic stop control.

18. The engine control device for the construction machine according to claim 4, wherein said engine control device further comprises warm-up state detecting means for detecting a warm-up state of said engine and warm-up necessity detecting means for detecting whether or not said engine is in a state where a warm-up operation is required, and that said control means comprising:

A) performing an automatic stop control in the condition that completion of the warm-up operation is detected by said warm-up state detecting means; and B) restarting said engine when said warm-up necessity detecting means detects that said engine is in the state where the warm-up operation is required after said engine is automatically stopped by said automatic stop control.

19. The engine control device for the construction machine according to claim 5, wherein said engine control device further comprises warm-up state detecting means for detecting a warm-up state of said engine and warm-up necessity detecting means for detecting whether or not said engine is in a state where a warm-up operation is required, and that said control means comprising:

A) performing an automatic stop control in the condition that completion of the warm-up operation is detected by said warm-up state detecting means; and B) restarting said engine when said warm-up necessity detecting means detects that said engine is in the state where the warm-up operation is required after said engine is automatically stopped by said automatic stop control.

* * * * *